US009704347B2

(12) United States Patent
Lark et al.

(10) Patent No.: US 9,704,347 B2
(45) **Date of Patent: *Jul. 11, 2017**

(54) LINE KENO AND KENO DRAWN BALL POSITION PAYS

(71) Applicant: IGT, Las Vegas, NV (US)

(72) Inventors: David R. Lark, Reno, NV (US); Bradford D. Brown, Sparks, NV (US)

(73) Assignee: IGT, Las Vegas, NV (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/074,720

(22) Filed: Mar. 18, 2016

(65) Prior Publication Data

US 2016/0203668 A1 Jul. 14, 2016

Related U.S. Application Data

(63) Continuation of application No. 13/957,360, filed on Aug. 1, 2013, now Pat. No. 9,293,013.

(51) Int. Cl.
*G07F 17/32* (2006.01)

(52) U.S. Cl.
CPC ..... *G07F 17/329* (2013.01); *G07F 17/326* (2013.01); *G07F 17/3239* (2013.01)

(58) Field of Classification Search
None
See application file for complete search history.

(56) References Cited

U.S. PATENT DOCUMENTS 4,033,588 A 7/1977 Watts
4,611,811 A 9/1986 Haase
4,661,906 A 4/1987 Difrancesco et al.
4,711,454 A 12/1987 Small
4,747,600 A 5/1988 Richardson
4,775,155 A 10/1988 Lees
4,798,387 A 1/1989 Richardson
4,875,686 A 10/1989 Timms
5,005,840 A 4/1991 Schwartz
5,043,887 A 8/1991 Richardson
5,046,737 A 9/1991 Fienberg
5,072,381 A 12/1991 Richardson et al.
5,100,139 A 3/1992 Di Bella
5,116,049 A 5/1992 Sludikoff et al.
5,158,293 A 10/1992 Mullins
5,242,163 A 9/1993 Fulton et al.
5,351,970 A 10/1994 Fioretti
5,401,024 A 3/1995 Simunek
(Continued)

FOREIGN PATENT DOCUMENTS

EP 1 513 116 3/2005
WO WO 2004/014502 2/2004
(Continued)

*Primary Examiner* — Jason Skaarup
(74) *Attorney, Agent, or Firm* — Neal, Gerber & Eisenberg LLP

(57) ABSTRACT

A method of providing a keno game for plays with duplicate draws is provided. A keno game including a keno game board having a first predetermined number of keno board spots is displayed. A player selection of a second predetermined number of keno board spots is received. Drawn balls for a plurality of ball sets are determined. The determined drawn balls are displayed with one or more paylines overlaying at least some of the drawn balls in the plurality of ball sets. A player award based at least in part on evaluation of each payline is calculated.

20 Claims, 7 Drawing Sheets

(56) References Cited

U.S. PATENT DOCUMENTS 5,419,592 A 5/1995 Stuart
5,482,289 A 1/1996 Weingardt
5,569,083 A 10/1996 Fioretti
5,586,937 A 12/1996 Menashe
5,628,684 A 5/1997 Boudec et al.
5,639,089 A 6/1997 Matsumoto et al.
5,647,798 A 7/1997 Falciglia
5,651,735 A 7/1997 Baba
5,679,077 A 10/1997 Pocock et al.
5,687,971 A 11/1997 Khaladkar
5,718,631 A 2/1998 Invencion
5,727,786 A 3/1998 Weingardt
5,743,526 A 4/1998 Inoueo
5,755,619 A 5/1998 Matsumoto et al.
5,779,545 A 7/1998 Berg et al.
5,800,269 A 9/1998 Holch et al.
5,813,911 A 9/1998 Margolin
5,823,534 A 10/1998 Banyai
5,848,932 A 12/1998 Adams
5,857,911 A 1/1999 Fioretti
5,871,398 A 2/1999 Schneier et al.
5,909,875 A 6/1999 Weingardt
5,935,001 A 8/1999 Baba
5,935,002 A 8/1999 Falciglia
5,945,655 A 8/1999 Gilgeous et al.
6,015,346 A 1/2000 Bennett
6,017,032 A 1/2000 Grippo et al.
6,024,640 A 2/2000 Walker et al.
6,033,306 A 3/2000 De Souza et al.
6,079,711 A 6/2000 Wei et al.
6,089,976 A 7/2000 Schneider et al.
6,089,978 A 7/2000 Adams
6,099,407 A 8/2000 Parker et al.
6,102,400 A 8/2000 Scott et al.
6,146,272 A 11/2000 Walker et al.
6,168,521 B1 1/2001 Luciano et al.
6,174,235 B1 1/2001 Walker et al.
6,183,361 B1 2/2001 Cummings et al.
6,186,892 B1 2/2001 Frank
6,210,276 B1 4/2001 Mullins
6,210,279 B1 4/2001 Dickinson
6,220,961 B1 4/2001 Keane et al.
6,241,606 B1 6/2001 Riendeau et al.
6,250,685 B1 6/2001 Walker et al.
6,257,980 B1 7/2001 Santini, Jr.
6,280,325 B1 8/2001 Fisk
6,283,855 B1 9/2001 Bingham
6,309,298 B1 10/2001 Gerow
6,309,300 B1 10/2001 Glavich
6,315,290 B1 11/2001 Roethel et al.
6,315,291 B1 11/2001 Moody
6,325,716 B1 12/2001 Walker et al.
6,336,862 B1 1/2002 Byrne
6,346,043 B1 2/2002 Colin et al.
6,358,151 B1 3/2002 Enzminger et al.
6,364,313 B1 4/2002 Moody
6,364,767 B1 4/2002 Brossard et al.
6,368,213 B1 4/2002 Mcnabola
6,368,214 B1 4/2002 Luciano
6,368,218 B2 4/2002 Angell, Jr.
6,398,644 B1 6/2002 Perrie et al.
6,398,645 B1 6/2002 Yoseloff
6,398,646 B1 6/2002 Wei et al.
6,402,614 B1 6/2002 Schneier et al.
6,419,583 B1 7/2002 Crumby et al.
6,425,823 B1 7/2002 Byrne
6,454,648 B1 9/2002 Kelly et al.
6,478,677 B1 11/2002 Moody
6,482,088 B2 11/2002 Santini, Jr.
6,514,144 B2 2/2003 Riendeau et al.
6,524,184 B1 2/2003 Lind et al.
6,524,185 B2 2/2003 Lind
6,533,660 B2 3/2003 Seelig et al.
6,533,664 B1 3/2003 Crumby
6,537,150 B1 3/2003 Luciano et al.
6,565,091 B2 5/2003 Weingardt
6,569,017 B2 5/2003 Enzminger et al.
6,581,935 B1 6/2003 Odom
6,585,590 B2 7/2003 Malone
6,599,188 B2 7/2003 Hirsch et al.
6,605,001 B1 8/2003 Tarantino
6,607,440 B2 8/2003 Santini, Jr.
6,609,973 B1 8/2003 Weiss
6,645,071 B2 11/2003 Perrie et al.
6,645,072 B1 11/2003 Kellen
6,656,044 B1 12/2003 Lewis
6,656,045 B2 12/2003 Wei et al.
6,672,960 B1 1/2004 B-Jensen
6,676,516 B2 1/2004 Baerlocher et al.
6,722,655 B1 4/2004 Camero
6,722,981 B2 4/2004 Kaminkow et al.
6,722,982 B2 4/2004 Kaminkow et al.
6,755,738 B2 6/2004 Glasson et al.
6,755,739 B2 6/2004 Santini, Jr.
6,761,632 B2 7/2004 Bansemer et al.
6,764,397 B1 7/2004 Robb
6,780,108 B1 8/2004 Luciano et al.
6,783,457 B2 8/2004 Hughs-Baird et al.
6,802,776 B2 10/2004 Lind et al.
6,824,465 B2 11/2004 Luciano, Jr.
6,832,956 B1 12/2004 Boyd et al.
6,835,138 B2 12/2004 Baeg
6,840,858 B2 1/2005 Adams
6,910,962 B2 6/2005 Marks et al.
6,981,635 B1 1/2006 Hughs-Baird et al.
7,040,984 B2 5/2006 Mead
7,160,186 B2 1/2007 Cuddy et al.
7,160,188 B2 1/2007 Kaminkow et al.
7,182,689 B2 2/2007 Hughs-Baird et al.
7,235,011 B2 6/2007 Randall et al.
7,258,608 B2 8/2007 Khal
7,273,415 B2 9/2007 Cregan et al.
7,303,469 B2 12/2007 Kaminkow
7,306,519 B2 12/2007 Baerlocher
7,314,409 B2 1/2008 Maya et al.
7,399,227 B2 7/2008 Michaelson et al.
7,544,129 B2 6/2009 Baerlocher
7,682,241 B2 3/2010 Baerlocher
7,824,257 B2 11/2010 Jubinville et al.
7,901,282 B2 3/2011 Cannon
8,025,561 B2 9/2011 Reddicks et al.
8,814,651 B1 8/2014 Humphrey et al.
2002/0045472 A1 4/2002 Adams
2002/0052231 A1 5/2002 Fioretti
2002/0094859 A1 7/2002 Hirsch et al.
2002/0098882 A1 7/2002 Lind et al.
2002/0098883 A1 7/2002 Packes et al.
2002/0111207 A1 8/2002 Lind et al.
2002/0111214 A1 8/2002 Lind et al.
2002/0113369 A1 8/2002 Weingardt
2002/0117803 A1 8/2002 Weingardt
2002/0137562 A1 9/2002 Malone
2002/0155877 A1 10/2002 Enzminger et al.
2002/0160827 A1 10/2002 Slomiany et al.
2002/0169018 A1 11/2002 Schneier et al.
2002/0177478 A1 11/2002 Glasson et al.
2003/0017867 A1 1/2003 Dekeller
2003/0073480 A1 4/2003 Thomas et al.
2003/0127793 A1 7/2003 Adams
2003/0144050 A1 7/2003 Keaton et al.
2003/0171986 A1 9/2003 Itkis et al.
2003/0178771 A1 9/2003 Banyai
2003/0181234 A1 9/2003 Falciglia
2003/0193136 A1 10/2003 Walker et al.
2003/0195032 A1 10/2003 Enzminger et al.
2004/0009806 A1 1/2004 Odom
2004/0048647 A1 3/2004 Lind et al.
2004/0053669 A1 3/2004 Gerrard et al.
2004/0106445 A1 6/2004 Perrie et al.
2004/0121834 A1 6/2004 Libby et al.
2004/0130096 A1 7/2004 Duhamel
2004/0152499 A1 8/2004 Lind et al.
2004/0166920 A1 8/2004 Boyd et al.
2004/0176169 A1 9/2004 Lind et al.

(56) References Cited

U.S. PATENT DOCUMENTS

| | | | |
|---|---|---|---|
| 2004/0178579 | A1 | 9/2004 | Lowell et al. |
| 2004/0204225 | A1 | 10/2004 | Campo et al. |
| 2004/0214626 | A1 | 10/2004 | Lind et al. |
| 2004/0235555 | A1 | 11/2004 | Yarbrough et al. |
| 2004/0242310 | A1 | 12/2004 | Perkins |
| 2004/0251628 | A1 | 12/2004 | Kilby |
| 2004/0266509 | A1 | 12/2004 | Bennett et al. |
| 2005/0054404 | A1 | 3/2005 | Baerlocher |
| 2005/0054415 | A1 | 3/2005 | Kaminkow et al. |
| 2005/0059449 | A1 | 3/2005 | Yarbrough |
| 2005/0059461 | A1 | 3/2005 | Ching et al. |
| 2005/0059467 | A1 | 3/2005 | Saffari et al. |
| 2005/0059468 | A1 | 3/2005 | Cannon |
| 2005/0059469 | A1 | 3/2005 | Gail et al. |
| 2005/0059470 | A1 | 3/2005 | Cannon |
| 2005/0059471 | A1 | 3/2005 | Cannon |
| 2005/0064932 | A1 | 3/2005 | Cannon |
| 2005/0075161 | A1 | 4/2005 | Mcglone et al. |
| 2005/0096119 | A1 | 5/2005 | Lind et al. |
| 2005/0096123 | A1 | 5/2005 | Cregan et al. |
| 2005/0101370 | A1 | 5/2005 | Lind et al. |
| 2005/0101387 | A1 | 5/2005 | Wolf |
| 2005/0119042 | A1 | 6/2005 | Chamberlain et al. |
| 2005/0130730 | A1 | 6/2005 | Lind et al. |
| 2005/0148382 | A1 | 7/2005 | Fox |
| 2005/0164771 | A1 | 7/2005 | Lind et al. |
| 2005/0164772 | A1 | 7/2005 | Lind et al. |
| 2005/0164773 | A1 | 7/2005 | Lind et al. |
| 2005/0167916 | A1 | 8/2005 | Banyai |
| 2005/0187014 | A1 | 8/2005 | Saffari et al. |
| 2005/0192081 | A1 | 9/2005 | Marks et al. |
| 2005/0227753 | A1 | 10/2005 | Luciano |
| 2005/0255906 | A1 | 11/2005 | Lind et al. |
| 2006/0084490 | A1 | 4/2006 | Khal |
| 2006/0178196 | A1 | 8/2006 | Thomas |
| 2006/0189375 | A1 | 8/2006 | Dodge |
| 2006/0246977 | A1 | 11/2006 | Cannon |
| 2007/0010308 | A1 | 1/2007 | Duhamel |
| 2007/0021185 | A1 | 1/2007 | Walker et al. |
| 2007/0052172 | A1 | 3/2007 | Dargue |
| 2007/0117611 | A1 | 5/2007 | Dodge |
| 2007/0135204 | A1 | 6/2007 | Nicely |
| 2007/0173313 | A1 | 7/2007 | Bienvenue |
| 2008/0102952 | A1 | 5/2008 | Walker et al. |
| 2008/0113742 | A1 | 5/2008 | Amos et al. |
| 2008/0254894 | A1 | 10/2008 | Michaelson et al. |
| 2009/0075714 | A1 | 3/2009 | Meyer et al. |
| 2009/0075715 | A1 | 3/2009 | Coleman et al. |
| 2009/0197664 | A1 | 8/2009 | Schultz |
| 2010/0004046 | A1 | 1/2010 | Brunelle |
| 2010/0120489 | A1 | 5/2010 | Meyer |
| 2010/0285862 | A1 | 11/2010 | Pau et al. |
| 2011/0028201 | A1 | 2/2011 | Warner et al. |
| 2013/0178271 | A1 | 7/2013 | Aponte et al. |
| 2014/0248935 | A1 | 9/2014 | Williams et al. |
| 2014/0274275 | A1 | 9/2014 | DeFrance et al. |

FOREIGN PATENT DOCUMENTS

| | | |
|---|---|---|
| WO | WO 2004/070551 | 8/2004 |
| WO | WO 2004/105903 | 12/2004 |
| WO | WO 2005/060567 | 7/2005 |
| WO | WO 2005/072096 | 8/2005 |
| WO | WO 2005/079142 | 9/2005 |

Keno Board 110

112

| | | | | | | | | | |
|---|---|---|---|---|---|---|---|---|---|
| 1 | 2 | 3 | 4 | 5 | 6 | 7 | 8 | 9 | 10 |
| 11 | 12 | 13 | 14 | 15 | 16 | 17 | 18 | 19 | 20 |
| 21 | 22 | 23 | 24 | 25 | 26 | 27 | 28 | 29 | 30 |
| 31 | 32 | 33 | 34 | 35 | 36 | 37 | 38 | 39 | 40 |
| 41 | 42 | 43 | 44 | 45 | 46 | 47 | 48 | 49 | 50 |
| 51 | 52 | 53 | 54 | 55 | 56 | 57 | 58 | 59 | 60 |
| 61 | 62 | 63 | 64 | 65 | 66 | 67 | 68 | 69 | 70 |
| 71 | 72 | 73 | 74 | 75 | 76 | 77 | 78 | 79 | 80 |

LINE KENO AND KENO DRAWN BALL POSITION PAYS

PRIORITY CLAIM

This application is a continuation of, and claims priority to and the benefit of, U.S. patent application Ser. No. 13/957,360, filed on Aug. 1, 2013, the entire contents of which are incorporated herein by reference.

BACKGROUND

The present disclosure relates generally to wager-based games and more particularly to keno games. A keno game typically displays to a player a keno board with eighty numbered selection spots. A player wagers by selecting six spots on the keno board. Next, twenty balls are drawn from eighty possible balls, with each ball having a number between one and eighty. The player is paid based on matches found between the drawn balls and the six player-selected spots on the keno board. For example, the player may have selected numbers 5, 21, 34, 36, 49, and 71 of which 5 and 21 match the ball drawn by the keno game. A paytable may dictate the payout amount that is due to the player depending on the number of matches detected. For example, a paytable may indicate that if there are four matches, then the payout amount is seven points.

SUMMARY

A method of providing a keno game for plays with duplicate draws, includes, but is not limited to any of the combination of: displaying a keno game including a keno game board having a first predetermined number of keno board spots; receiving a player selection of a second predetermined number of keno board spots; determining drawn balls for a plurality of ball sets; displaying the determined drawn balls with one or more paylines overlaying at least some of the drawn balls in the plurality of ball sets; and calculating a player award based at least in part on evaluation of each payline.

An electronic device for playing a keno game includes a display configured to display the keno game to a player having a keno board with a first predetermined number of keno board spots, a user-input panel and a game controller having one or more data processors and one or more storage devices storing instructions that, when executed by the one or more data processors, cause the one or more data processors to perform various operations. The operations may include receiving a player selection of a second predetermined number of keno board spots; determining drawn balls for a plurality of balls sets; displaying the determined drawn balls with one or more paylines overlaying on top of at least some of the drawn balls in the plurality of drawn ball sets and calculating a player award based at least in part on evaluation of each payline.

A computer-readable storage medium has machine instructions stored therein that are executable by a processor to cause the processor to perform operations including displaying a keno game including a keno game board having a first predetermined number of keno board spots; receiving a player selection of a second predetermined number of keno board spots; determining drawn balls for a plurality of balls sets; displaying the drawn balls in the plurality of ball sets, wherein the plurality of ball sets are visually divided into one or more areas; and calculating player award based at least in part on relative position of drawn balls with respect to each other within each area.

A method of providing a keno game includes displaying a keno game including a keno game board having a first predetermined number of keno board spots; receiving a player selection of a second predetermined number of keno board spots; determining drawn balls for a plurality of balls sets; displaying the drawn balls in the plurality of balls sets, wherein the plurality of balls sets are visually divided into one or more areas; and calculating player award based at least in part on relative position of drawn balls with respect to each other within each area.

BRIEF DESCRIPTION OF THE DRAWINGS

The details of one or more implementations are set forth in the accompanying drawings and the description below. Other features, aspects, and advantages of the disclosure will become apparent from the description, the drawings, and the claims, in which:

DETAILED DESCRIPTION

Figure 1A:
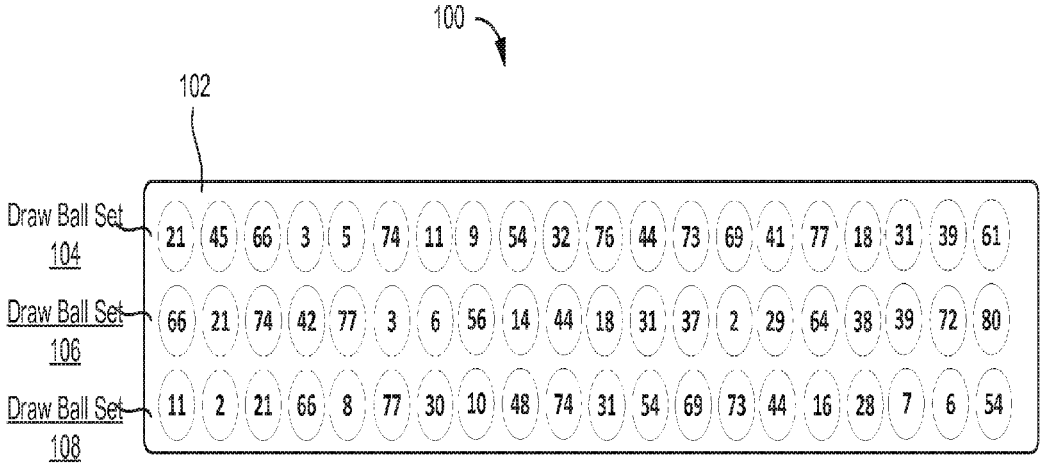
FIGS. 1A-C are illustrations of a keno game that rewards a player using lines drawn over groups of drawn ball sets in an accordance with an example implementation.
Figure 1A:
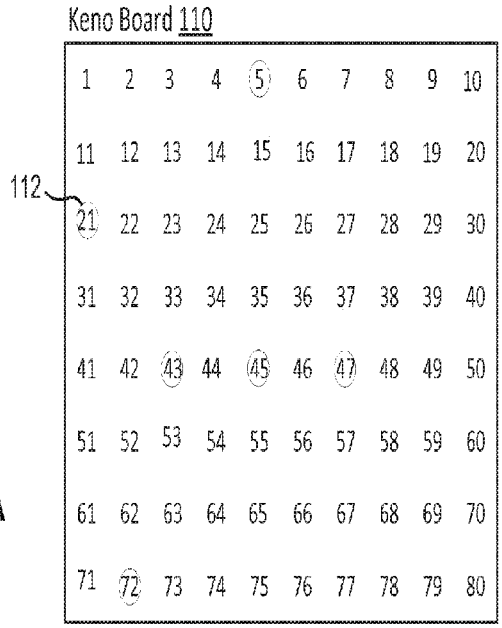

Numerous specific details may be set forth below to provide a thorough understanding of concepts underlying the described embodiments. It may be apparent, however, to one skilled in the art that the described embodiments may be practiced without some or all of these specific details. In other instances, some process steps have not been described in detail in order to avoid unnecessarily obscuring the underlying concept.

During a keno game, the player may select and mark spots on a keno board shown to the player on an electronic display of a gaming machine or the player's computing device. The player selected keno board spots are numbers selected by the player, which are a sub-set of the total set of available numbers. For example, the total set of available numbers may include eighty unique numbers (i.e., numbers from one to eighty) and the sub-set of numbers selected by the player may be six numbers. The set of available numbers may be shown on the keno board as numbered balls, numbered squares or any other visual representation. Once the player selects the sub-set of numbers, the keno game randomly selects a set of numbers from the available set of numbers. For example, twenty randomly selected numbers may be selected and displayed to the player. The randomly selected numbers may be shown to the player as "ball drops". After each number in the set of numbers is randomly selected, it may be removed from the set of available numbers and may not be available to be selected again until another keno game. When more than one set of numbers is selected during a single keno game, each randomly selected number is removed from the set of available numbers and is available to be subsequently selected again when the next set of drawn numbers are selected during the same keno game or the next keno game.

According to various embodiments disclosed herein, at least two sets of balls are drawn during a keno game. Any number of drawn ball sets may be drawn (e.g., three, four, five, twenty, etc.). The number of drawn ball sets may vary from one keno game to another. Each set of drawn balls may include the same number of balls. For example, four ball sets are drawn with twenty balls in each set. Each of the drawn ball sets may be drawn from a separate set of, e.g., eighty balls. Furthermore, each set of drawn balls may include uniquely numbered balls (e.g., numbered from one to eighty, with no duplicates within a single drawn ball set). However, duplicate drawn balls may appear across different drawn ball sets. For example, a ball numbered "5" can appear in two drawn ball sets.

Each set of drawn balls may be separately evaluated by comparing the balls in each drawn ball set to the balls selected by the player. Accordingly, the player may have more matches due to a higher number of drawn balls being evaluated. Alternatively, the evaluation criteria may span multiple sets of drawn balls. The sets of drawn balls may be displayed to the player in a grid pattern. For example, the grid pattern may be twenty balls wide and the number of drawn table sets tall (e.g., 3 balls tall). In this example, the drawn balls sets are displayed as three horizontal groups of drawn balls, with each horizontal group containing twenty drawn balls from one of the drawn ball sets. As another example, instead of three 1×20 grids stacked vertically, other grid patterns may be used. For example, for three sets of drawn balls, three 4×5 grids placed side-by-side next to each other may be displayed.

One or more paylines may be overlayed on top of at least some of the shown drawn balls. The total number of balls that each payline touches may be equal to the number of balls in a drawn ball set (e.g., twenty). The shapes of the paylines may vary (e.g., horizontal, vertical, angled, or any combination thereof). As a result, a high number of possible paylines may be used for determining payout to the player. In some embodiments, the number of lines may be limited to a predetermined number (e.g., 5, 10, 15). Additionally, the use of angled paylines, for example, may cause the award evaluation criteria to span more than one of the drawn ball sets. That is, balls from more than one of the drawn ball sets may be considered in determining the payout to the player.

Each payline may be evaluated individually to determine the player payout. In some embodiments, the balls that a payline hits may be evaluated against the player marked balls. When a payline includes duplicate balls, the duplicate balls may be used as a further pay category with a duplicate paytable or another source dictating payout to the player for the detected number of duplicates on a payline. As another example, the existence of player marked balls appearing adjacent to each other on a payline may be used as a further pay category. In some embodiments, when predetermined balls are detected on a payline, the player may be paid a payout or given another type of award. Accordingly, in addition to evaluation of each drawn ball set against the player selected keno board spots, each payline may be evaluated.

In some embodiments, the illustrated drawn balls sets may be divided into boxes or into any other type of areas. For example, if four sets of twenty balls are drawn and displayed as four rows of twenty balls, then the eighty drawn balls may be divided into five boxes each of which contains sixteen balls. The payout to the player may include evaluation of drawn balls within each box. In particular, each box may be evaluation separately, and balls from more than one of the drawn ball sets may be considered in determining the payout to the player. Hence, the evaluation criteria may span more than one of the drawn ball sets. For example, duplicates detected within a box may trigger a bonus or payout to the player. Paylines may be drawn that pass through each box. A payline drawn within a box may be a horizontal line, a vertical line, and/or a combination of angled line segments and/or straight line segments, or any combination thereof. Each payline within a box may be evaluation individually. For example, the player may rewarded when drawn balls that are "hits" touch the payline. In some embodiments, when more than a threshold number of hits are detected on paylines within a box, an additional payout to the player may be provided. In some embodiments, when more than a predetermined number of drawn balls (e.g., two or more drawn balls) are "hits" on the payline and are located within a box and/or next to one another, the player may be rewarded.

In some embodiments, drawn balls that are not "hits" for the player's marked spots may be evaluated based on their relative position to each other. For example, when particular drawn balls appear on a payline, the player may be awarded a payout. In another example, when two or more drawn balls that are "hits" appear next to each other on a payline and/or within a single box, the player may be awarded.

FIG. 1A illustrates a keno game in which three sets of twenty balls are drawn. Drawn ball sets 104, 106, and 108 are shown. In particular, the balls in each drawn ball set are displayed in a horizontal line. Each set of drawn balls may be drawn from a separate set of balls numbered one through eighty or from a single set of eighty balls with all the balls being available for drawing for each new drawn set.

As shown, each set of drawn balls 104, 106, and 108 includes balls uniquely numbered between one and eighty. In some embodiments, there may be a predetermined maximum number of allowed duplicate balls between the drawn sets. In other embodiments, duplicate balls may not be allowed across the multiple drawn ball sets or the duplicate balls may be allowed in a predetermined maximum number of draw ball sets.

As shown, the draw ball set 104 includes balls numbered "21", "45", "66", "3", "5", "74", "11", "9", "54", "32", "76", "44", "73", "69", "41", "77", "18", "31", "39", and "61". The draw ball set 106 includes balls numbered "66", "21", "74", "42" "77" "3" "6" "56" "14" "44" "18" "31", "37" "2", "29", "64", "38", "39", "72", and "80", while the draw ball set 108 includes balls numbered "11", "2", "21", "66", "8", "77", "30", "10", "48", "74", "31", "54", "69", "73", "44", "16", "28", "7", "6", and "54". Although three sets of drawn balls are illustrated, there may be any number of drawn sets (e.g., 5, 10, 15, etc.).

The drawn ball sets 104, 106, 108 may be displayed to the player of a keno game on an electronic display of a gaming machine or a user computing device. For example, after the player marks balls on the keno board, the sets of drawn balls may be selected and displayed to the player. The duplicate balls across the multiple draw ball sets may be visually highlighted in order to draw the player's attention to the duplicate balls. For example, colors, patterns or other visual indicator can be used to emphasize the duplicate balls across the multiple drawn ball sets.

A keno board 110 is shown with eighty spots numbered one through eighty. The keno board 110 shows the player marked balls (e.g., spot 112) including balls numbered "5", "21", "43", "45", "47", "72". The six player marked balls are shown on the keno board 110 by drawing a ball around the corresponding number on the keno board. In some embodiments, the player may be allowed to select any other number of keno board balls (e.g., 8 balls).

Figure 1B:
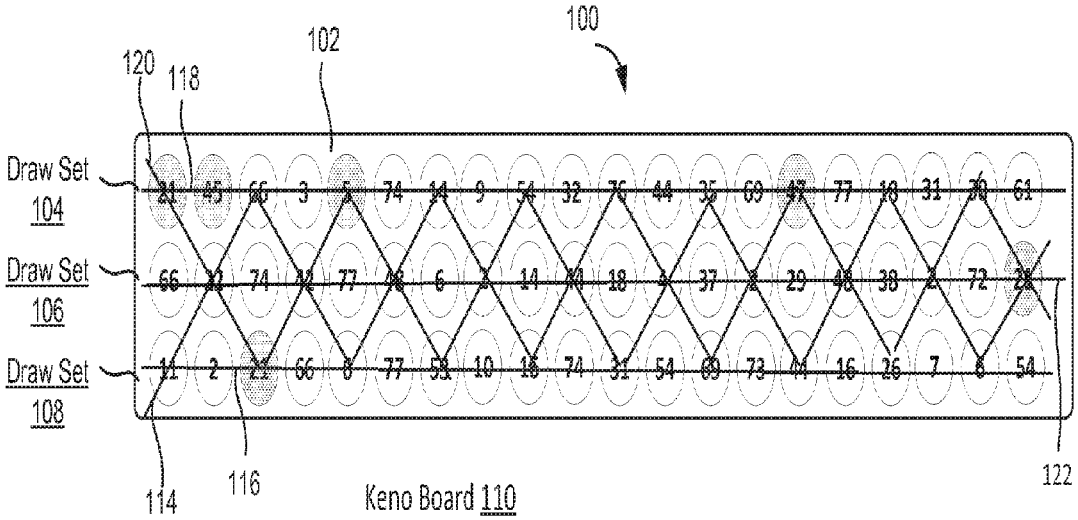

Now referring to FIG. 1B, drawn balls overlayed with paylines, with each payline overlaying balls in one or more draw ball sets, are shown. In particular, five paylines 114, 116, 118, 120, and 122 are displayed in FIG. 1B. The payline 118 is a horizontal line that touches all the balls in the draw ball set 104. The paylines 122 and 116 are horizontal lines that touch the balls in the draw ball sets 106 and 108, respectively. The paylines 120 and 114 include multiple angled segments, and each of these paylines may overlay balls in all three draw ball sets 104, 106, and 108. For example, the payline 120 touches balls numbered "21" in the draw ball set 104, ball numbered "22" in the draw ball set 106, and ball numbered "21" in the draw ball set 108, among other balls. The drawn balls that are "hits" (i.e., the drawn balls that match the player selected balls) are emphasized in FIG. 1B with a different background than the rest of the drawn balls. Any type of visualization can be utilized to bring the player's attention to the drawn balls that are "hits".

The drawn balls touching the paylines may be utilized for calculating payout to the player. Each payline may be evaluated separately to determine payout to the player. An evaluation of a payline may involve detecting matches between the player's marked balls and the balls that are touched by the payline. "Hits" that are next to each other on the same payline may score additional points. In some embodiments, when predetermined drawn balls show up on the same payline, the player may be awarded a payout.

Figure 1C:
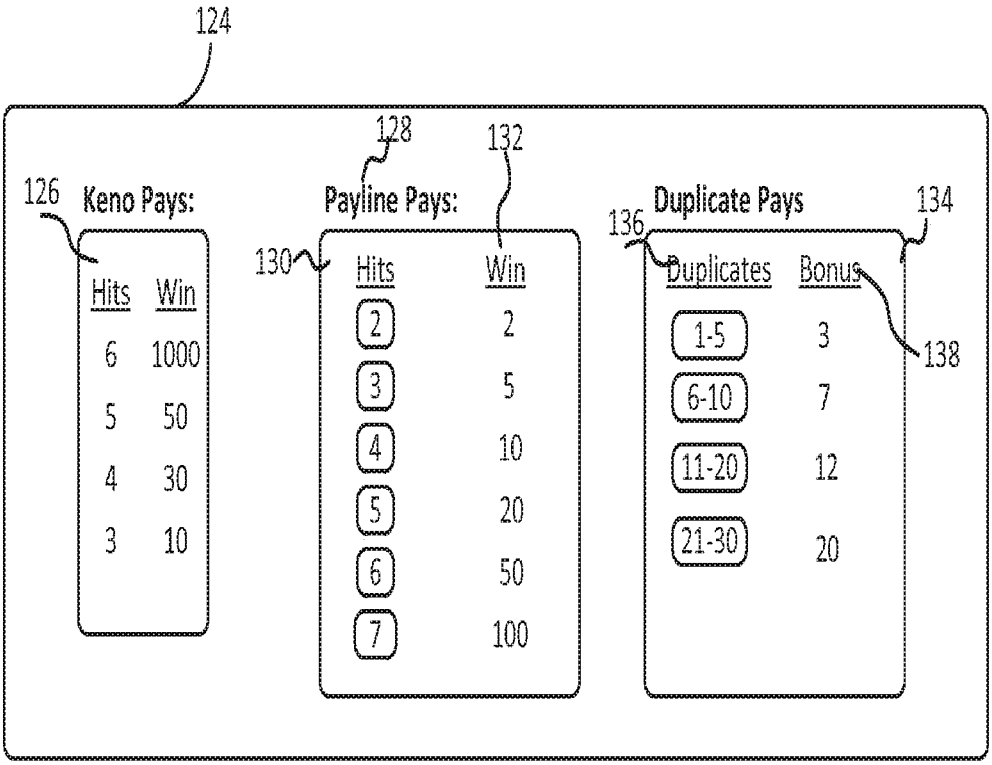

FIG. 1C illustrates a payline paytable 128 that may be used for determining payout to the player for paylines having "hits". A column 130 provides various numbers of hits, while a column 132 provides corresponding win amounts. For example, when a payline passes through a total of five balls selected by the player, the payout amount is twenty credits. Referring back to FIG. 1B, the payline 114 passes through two hits (yielding two points), the payline 116 passes through one hit (yielding zero points), the payline 118 passes through four hits (yielding ten points), the payline 120 passes through four hits (yielding ten points), and the payline 122 passes through one hit (yielding zero points). As will be appreciated, although the paytable is shown as providing bonuses for up to seven payline hits, in practice, the paytable may provide bonuses for, e.g., up to twenty payline hits (if the total number of drawn balls is twenty).

The payline paytable 128 may include other numbers of hits and win values other than shown in FIG. 1C. In some embodiments, other paytables or information associated with the paylines overlaying the drawn balls may be utilized to award the player a payout.

FIG. 1C further illustrates a paytable 134 for rewarding the player for detected duplicate balls among the drawn ball sets. As illustrated in FIGS. 1A and 1B, the draw ball sets 104, 106, 108 include balls that are duplicates. In particular, the balls numbered "21", "66", "74", "54", "44", "69", "77", "18", "31", "39", "6", "44", "31", and "2" have duplicates across the three draw ball sets. For example, the ball numbered "21" appears in all three draw ball sets. In FIGS. 1A and 1B, fourteen balls have duplicates resulting in the player being awarded 12 credits. The paytable 134 may provide payout to the player for a total number of balls that have duplicates in the draw ball sets, regardless the composition of the duplicates (e.g., whether there are any "three of a kinds" or more). In other embodiments, "of a kinds" may be taken into account. For example, two three-of-a-kinds may be awarded more points than three pairs. In some embodiments, additional points may be awarded if the duplicates are also keno hits, if they appear next to each other on a payline (e.g., in the case of an angled payline), and so on. Although the shown specific numbers of points are assigned to various numbers of total duplicates, any number of credits may be assigned to any number of duplicates.

A keno paytable 126 awards the player for matches between player marked spots and the drawn balls. In some embodiments, all the draw ball sets are evaluated to determine the win for the player. As shown, the player marked six keno board spots numbered "5", "21", "43", "45", "47", and "72". Of these six player selected keno board spots, the spots numbered "5" and "21" appear in the draw ball sets 104, 106, and 108. In particular, the ball numbered "5" appears once in the draw ball set 104, while the ball numbered "21" appears in the draw ball sets 104, 106, and 108. In some embodiments, each drawn ball set may be evaluated individually, and the score for each drawn ball set may be added. In other embodiments, the player may be awarded based on the total number of hits across all of the drawn ball sets.

Figure 2A:
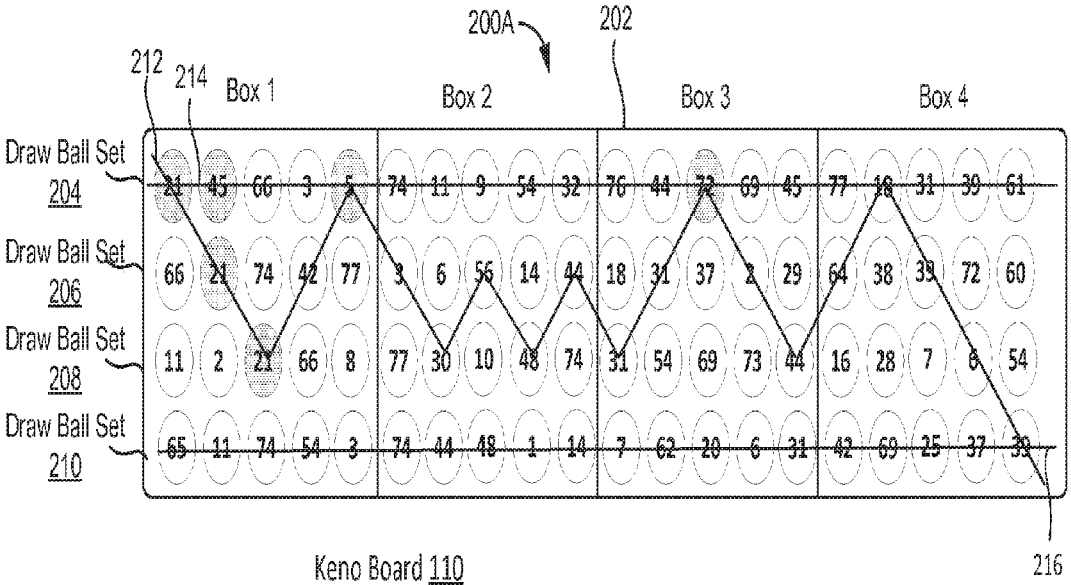
FIGS. 2A-B are illustrations of a keno game that rewards a player using multiple payout calculations, in an accordance with an example implementation.
Figure 2A:
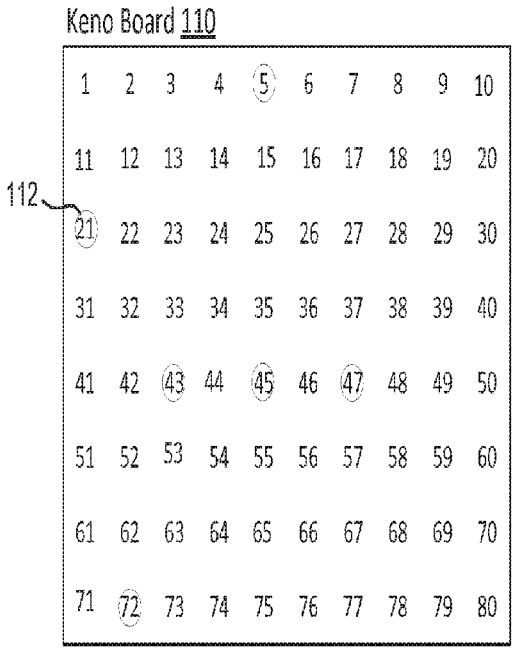
Figure 2B:
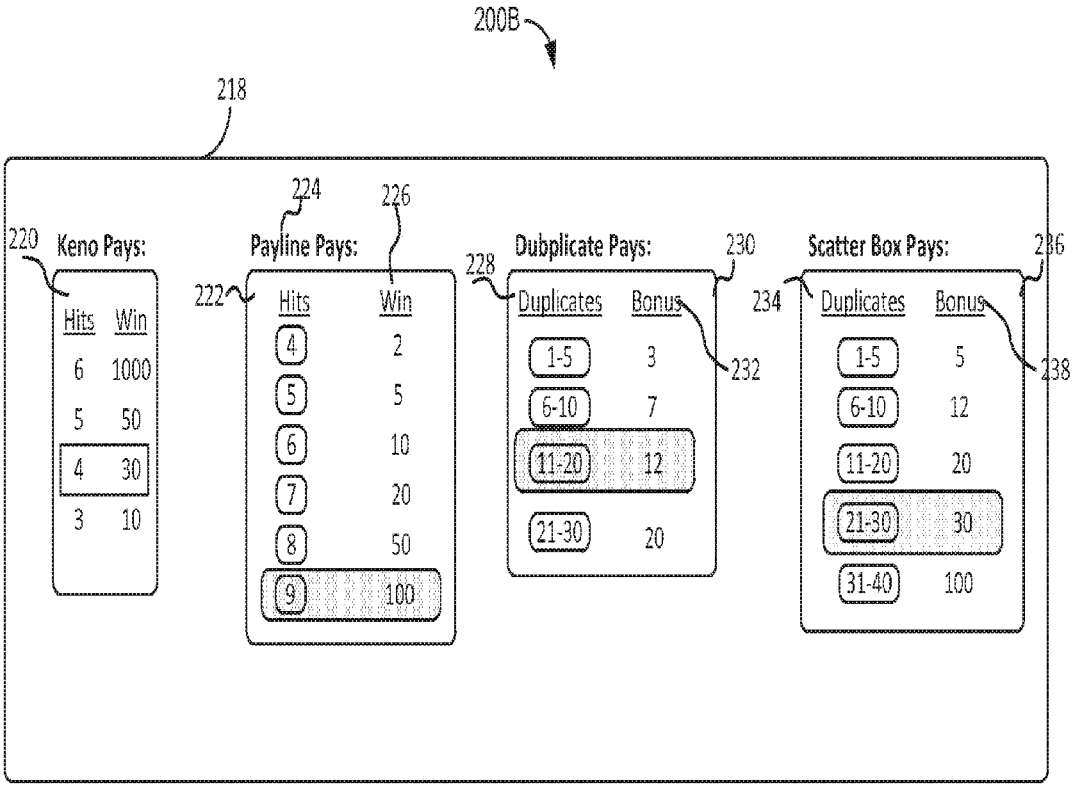

Referring now to FIGS. 2A-B, illustrations 200A-B of a keno game which awards the player based on multiple criteria are shown, according to an exemplary embodiment. The illustrations 200A-B of the keno game can be displayed to a player on a display of a gaming machine, or on a webpage or an application installed on a computing device utilized by the player.

The illustration 200A shows a grid 202 and the keno board 110. The grid includes four draw ball sets 204, 206, 208, and 210, each drawn as a horizontal group of drawn balls. As shown, each drawn ball set contains twenty drawn balls and does not include any duplicates. However, there may be duplicate balls across the multiple drawn ball sets 204, 206, 208, and 210.

The illustration 200A of the keno game includes the keno board 110, which displays eighty spots with each spot numbered one to eighty, as well as the player marked six spots (e.g., spot 112) numbered "5", "21", "43", "45", "47", and "72". Once the player marks the six spots, twenty balls (or any number of balls) are drawn four times resulting in four draw ball sets 204, 206, 208, and 210 as illustrated in the grid 202. Each set of drawn balls may be drawn from a separate set of balls numbered one through eighty or from a single set of eighty balls with all the balls being available for drawing for each set.

The illustration 200A further displays paylines 212, 214, and 216 drawn across one or more draw ball sets within the grid 202. For example, the payline 214 is a horizontal line that touches all the balls in the draw ball set 204. The payline 216 is also shown as a horizontal line that is drawn across the draw ball set 210, touching all the balls in the draw ball set 210. Finally, the payline 212 is composed of angled line segments, and it is drawn across three draw ball sets 204, 206, 208, and 210 touching some of the balls in these draw ball sets. The drawn balls that are "hits" are emphasized in FIG. 2A with a different background than the rest of the drawn balls. Any type of visualization can be utilized to bring the player's attention to the drawn balls that are "hits".

The grid 202 is divided into four boxes labeled as Box 1, Box 2, Box 3, and Box 4. As shown, each box is five drawn balls wide by four drawn balls tall. For example, Box 1 includes the first five balls of each draw ball set 204, 206, 208, and 210. Other box sizes may be utilized (e.g., two by ten, 10 by two, four by five, etc.), and the grid of draw ball sets may be divided into any number of boxes or other shapes (e.g., tetris type shapes). The Boxes 1, 2, 3, and 4 may be evaluated to determine whether any duplicates occur within each box area. The player may be paid a payout amount when duplicates are detected in the Boxes 1, 2, 3, and/or 4.

In some embodiments, the drawn ball sets 204, 206, 208, and 210 may be evaluated based on their relative positions to each other. Accordingly, this method of evaluation is not tied to the player's marked spots. For example, position of the drawn balls in relation to each other on a payline or within the same "box" or "area" (e.g., boxes shown in FIG. 2A) may be evaluated. In some embodiments, when the drawn ball sets are shown in horizontal groups and paylines are draw across them, only paylines with angled segments may be evaluated (since the horizontal lines do not have duplicates). In some embodiments, rather than being displayed in horizontal rows, drawn ball sets may each fill one of the boxes (i.e., 4 by 5 grid in FIG. 2A) which would create the potential for duplicates on horizontal paylines.

Now referring to FIG. 2B, the illustration 200B of the keno game is shown, which includes the display section 202 and paytables 220, 224, 230, and 236 used for awarding the player during the keno game. The keno paytable 220, the payline paytable 224, and the paytable 230 are similar to the keno pays paytable 126, the payline paytable 132, and the duplicates paytable 134 shown in FIG. 1C.

The payline paytable 224 awards the player when the balls in the drawn ball sets 204, 206, 208, and 210 that match the balls selected by the player touch the paylines. For example, as shown, the player selected a ball numbered "5" on the keno board 110. The ball "5" appears in the drawn ball set 204, and is touched by the paylines 212 and 214. The player also selected the ball numbered "21" labeled as 212 on the keno board 110, and it appears in the drawn ball sets 204, 206, and 208. The payline 212 touches a ball numbered "21" three times and the payline 214 touches the ball numbered "21" in the draw ball set 204. Drawn balls "45" and "72" in the draw ball set 204 touch the paylines 212 and 214. The rest of the balls selected by the player (i.e., balls numbered "43", and "47") do not appear in the draw ball sets 204, 206, 208, and 210. As a result, the drawn balls that are also selected by the player are "hit" by the paylines 212 and 214 a total of nine times. In accordance with the payline paytable 224, the player is entitled to one hundred credits for the nine payline hits.

The paytable 230 rewards the player for detected duplicate balls among the drawn ball sets 204, 206, 208, 210. As illustrated in FIG. 2A, the draw ball sets 204, 206, 208 and 210 include balls that are duplicates. The balls numbered "21", "66", "74", "54", "44", "69", "77", "18", "31", "39", "6", "44", "31", and "2" have duplicates across the four draw ball sets. The ball numbered "44" appears in the four draw ball sets 204, 206, 208, 210. As shown in FIG. 2A, fourteen balls have duplicates resulting in the player being awarded 12 credits. In other embodiments, the payout for duplicates across the drawn balls set involves determining a total number of duplicates (e.g., thirty five duplicate balls are shown in FIG. 2A) and paying predetermined credit amount for the total number of duplicates. In other embodiments, the player may be awarded based on the composition of the duplicates (e.g., based on three or more "of a kind" matches).

As discussed with respect to FIG. 1C, similar to the paytable 126, the keno paytable 220 awards the player for detected matches between player marked spots and the drawn balls. Drawn ball set 204 has four matches (yielding thirty points), drawn ball set 206 has one match (yielding no points), drawn ball set 208 has one match (yielding no points), and drawn ball set 210 has no matches (yielding no points). In other embodiments, the total number of matches across all drawn ball sets may be evaluated rather than evaluating each drawn ball set individually.

The scatter box paytable 236 rewards the player for duplicates detected within each box area. The paytable 236 includes a column 234 that provides ranges of a total number of duplicate balls, and a column 238 that provides the payout for each range of duplicate balls. For example, when one to five duplicates balls are detected in the Box areas 1, 2, 3, and 4, the player is entitled to five credits. Box 1 area is shown to include three balls numbered "21", two balls numbered "3", and two balls numbered "66". Box 2 area includes three balls numbered "74", two balls numbered "48", two balls numbered "44", and two balls numbered "14". Box 3 area includes two balls numbered "44", two balls numbered "69", three balls numbered "31". Box 4 area includes two balls numbered "39". The total number of duplicate balls is twenty five. The paytable 236 dictates that for more than twenty one duplicates balls, the player is entitled to a bonus of thirty credits.

In other embodiments, points may be awarded based on an evaluation of the number of duplicates in each box individually rather than the total number of duplicates all boxes. In other embodiments, the duplicates column can include values for "of a kind" balls. For example, if two balls numbered "3" and four balls numbered "58" are detected by analyzing balls in each box, then the total number "of a kind" balls is one four-of-a-kind and one two-of-a-kind.

Although FIGS. 1A-B and 2A display keno boards with six keno board spots marked by a player, the number of spots marked by the player may be any number. The number of drawn balls may be any number (e.g., fifty, one hundred, etc.). In some embodiments, duplicates may be allowed within a single draw ball set (i.e., each drawn ball being a separate draw).

Figure 3:
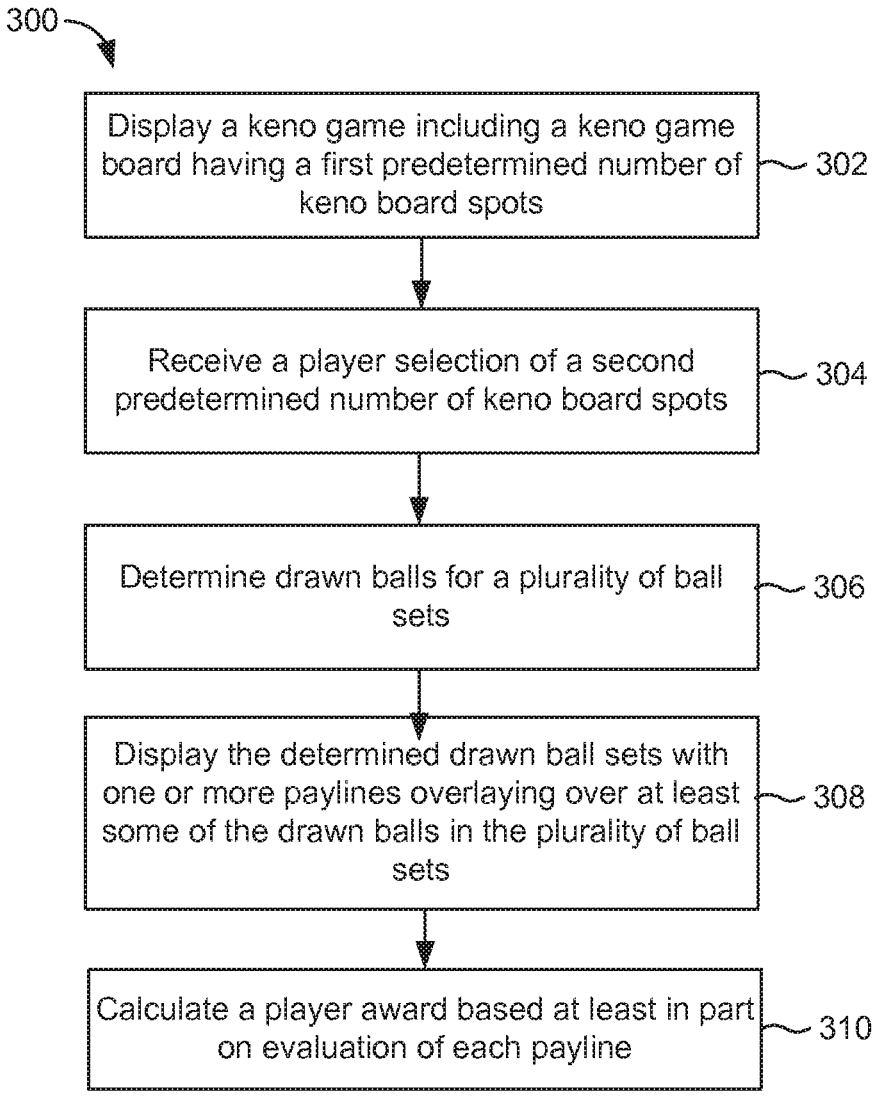
FIG. 3 is a flow diagram of a process for calculating payout during a keno game, in an accordance with an example implementation.

FIG. 3 is a flow diagram of a process 300 for awarding a player payout amount during a keno game that allows for multiple sets of drawn balls, in accordance with an illustrative embodiment. The process 500 can be implemented on a computing device (e.g., a gaming machine, a user device, etc.). In one embodiment, the process 300 is encoded on a computer-readable medium that contains instructions that, when executed by the computing device, cause the computing device to perform operations of the process 300.

The process 300 includes displaying (block 302) a keno board having a first predetermined number of keno board spots. In some embodiments, the first predetermined number of keno board spots may be equal to eighty spots. In these embodiments, the displayed keno board may be a ten by eight board, with each spot labeled with a number between one and eighty. In some embodiments, any other number of keno board spots may be displayed (e.g., fifty spots, one hundred spots, etc.).

The process 300 further includes receiving (block 304) a player selection of a second predetermined number of keno board spots. The second predetermined number of keno spots maybe six or any other number. When using a touch screen device, the user may mark the keno spots by touching the touch screen. In another example, the user may mark the keno board spots by selecting the keno spots using a mouse indicator or buttons.

The process 300 further includes determining (block 306) drawn balls for a plurality of drawn ball sets. Each ball set may be include a predetermined number of balls (e.g., twenty). In some embodiments, each drawn ball set may not include any duplicate balls, while the duplicate balls may be allowed between the multiple drawn ball sets. The number of drawn ball sets may be any number (e.g., four, ten, one-hundred, etc). As shown, in FIG. 2A, four draw ball sets are drawn, with each draw ball set including twenty balls.

At block 308, the determined drawn balls in the plurality of ball sets along with one or more paylines overlaying at least some of the drawn balls in the plurality of ball sets are displayed. In some embodiments, each drawn ball set has the same number of drawn balls and the total number of balls that each payline hits may equal the number of ball in each drawn ball set. For example, if each of the drawn ball sets includes twenty balls, then each payline hits twenty balls in one or more drawn ball sets. A payline may be a horizontal line, a vertical line, or a line made up of angled and/or straight line segments. FIGS. 1A-B and 2A provide examples of drawn ball sets and paylines.

The process 300 further includes calculating (block 310) a player award for the player. The payout award may be based at least in part on evaluation of each payline. For example, matches between player selected keno board spots and the payline hits of the drawn balls may be determined. A paytable (e.g., the paytable 128) may be displayed to the player including information between various numbers of matches and payout amounts. In some embodiments, the total number of matches is used to calculate the player award. In other embodiments, the number "of a kind" balls that have matches between the payline hits and the player selections may be used to calculate the payout amount.

The player award may be based on any combination of: evaluation of traditional keno marks and hits (i.e., the number of matches detected between player marked spots and drawn balls), evaluation of "payline" marks and hits (i.e., matches between the balls that the paylines hit and the player marked spots), evaluation of duplicates (e.g., duplicates across the drawn balls, duplicates on paylines, duplicates detected within Box areas used to divide up the drawn balls, etc.), evaluation of drawn balls based on the relative position of the balls to each other (e.g., within the same box, next to each other on a payline, more for duplicates and other "of a kind" hits), and so on. The total player award due to the player may include points calculated using any combination of these methodologies.

Figure 4:
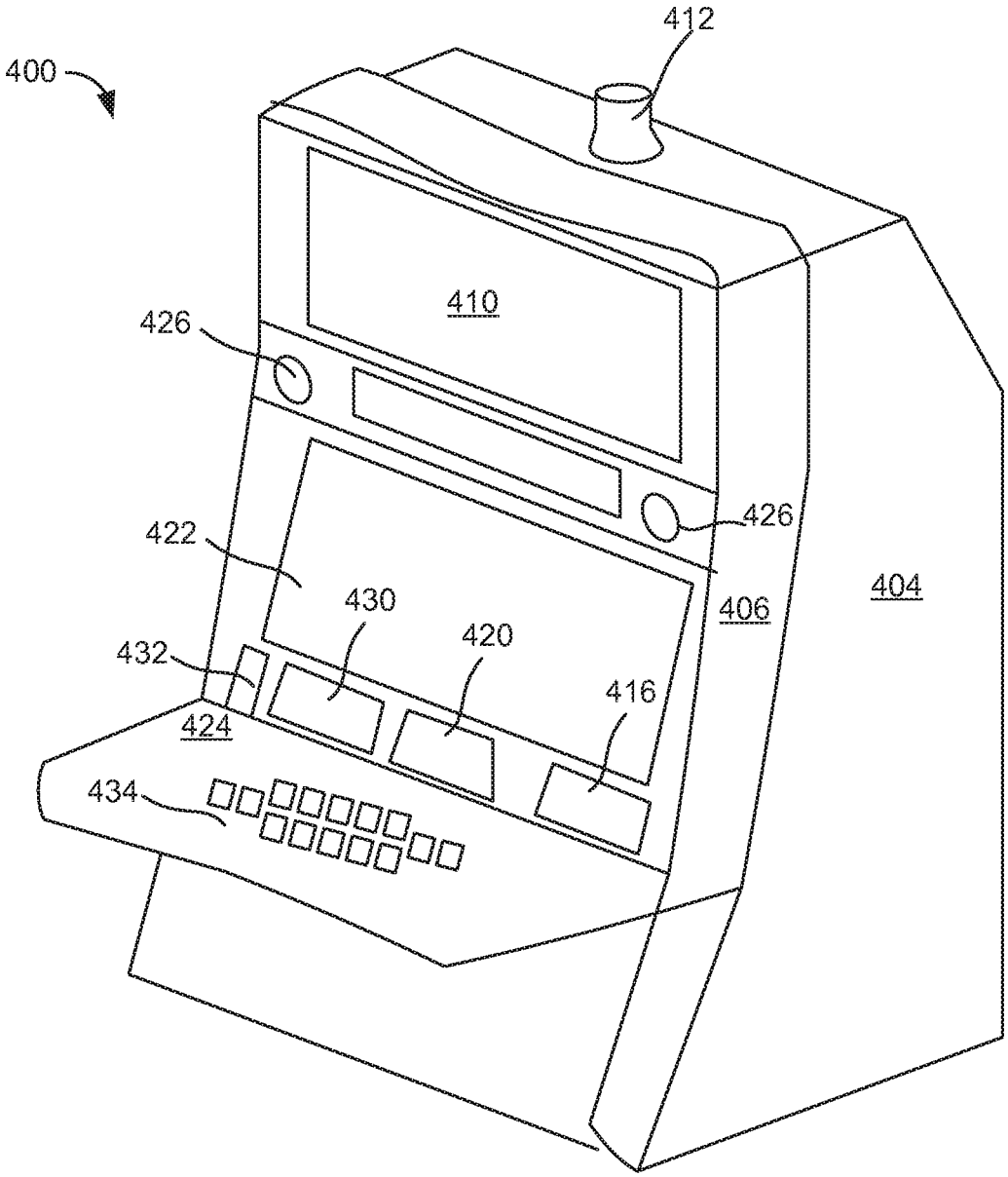
FIG. 4 is a diagram of an electronic gaming machine, in an accordance with an example implementation.

Referring to FIG. 4, a perspective drawing of an electronic gaming machine 400 is shown in accordance with described embodiments. The gaming machine 400 may include a main cabinet 404. The main cabinet 404 may provide a secure enclosure that prevents tampering with device components, such as a game controller (not shown) located within the interior of the main cabinet 404. The main cabinet 404 may include an access mechanism, such as a door 406, which allows the interior of the gaming machine 400 to be accessed. Actuation of the door 406 may be controlled by a locking mechanism. In some embodiments, the locking mechanism, the door 406, and the interior of main cabinet 404 may be monitored with security sensors of various types to detect whether the interior has been accessed. For instance, a light sensor may be provided within the main cabinet 404 to detect a change in light-levels when the door 406 is opened and/or an accelerometer may be attached to the door 406 to detect when the door 406 is opened.

The gaming machine 400 may include any number of user interface devices that convey sensory information to a user and/or receive input from the user. For example, the gaming machine 400 may include electronic displays 440 and/or 422, speakers 426, and/or a candle device 412 to convey information to the user of the gaming machine 400. The gaming machine 400 may also include a console 424 having one or more inputs (e.g., buttons, track pads, etc.) configured to receive input from a user. In one embodiment, the display 410 and/or the display 422 may be a touch screen display configured to receive input from a user. A controller (not shown) within the gaming machine 400 may run a game, such as a wager-based game (e.g., a keno game), in response to receiving input from a user via inputs located in the console 424, display 422, or display 410. For example, inputs located in the console 424 may be operated to place a wager in the game and to run the game. In response, the controller may cause the display 422 to show a wager-based game such as a keno game.

The gaming machine 400 may also include devices for conducting a wager-based game. For example, the gaming machine 400 may include a ticket acceptor 416 and a printer 420. In various embodiments, the gaming machine 400 may be configured to run on credits that may be redeemed for money and/or other forms of prizes. The ticket acceptor 416 may read an inserted ticket having one or more credits usable to play a game on the gaming machine 400. For example, a player of the gaming machine 400 may wager one or more credits within a video keno game. If the player loses, the wagered amount may be deducted from the player's remaining balance on the gaming machine 400. However, if the player wins and is awarded an award, the player's balance may be increased by the amount won and/or awarded. Any remaining credit balance on the gaming machine 400 may be converted into a ticket via the printer 420. For example, a player of the gaming machine 400 may cash out of the machine by selecting to print a ticket via the printer 420. The ticket may then be used to play other gaming machines or redeemed for cash and/or prizes. According to various embodiments, the gaming machine 400 may record data regarding its receipt and/or disbursement of credits.

In one embodiment, the gaming machine 400 may include a loyalty card acceptor 430. In general, a loyalty card may be tied to a user's loyalty account. A loyalty account may store various information about the user, such as the user's identity, the user's gaming preferences, the user's gaming habits (e.g., which games the user plays, how long the user plays, etc.), or similar information about the user. A loyalty account may also be used to reward a user for playing the gaming machine 400. For example, a user having a loyalty account may be given an award turn on the gaming machine 400 or credited loyalty points for playing the gaming machine 400. Such loyalty points may be exchanged for loyalty rewards (e.g., a free meal, a free hotel stay, free room upgrade, discounts, etc.).

Implementations of the subject matter and the operations described in this specification can be implemented in digital electronic circuitry, computer software, firmware or hardware, including the structures disclosed in this specification and their structural equivalents or in combinations of one or more of them. Implementations of the subject matter described in this specification can be implemented as one or more computer programs, i.e., one or more modules of computer program instructions, encoded on one or more computer storage medium for execution by, or to control the operation of data processing apparatus. Alternatively or in addition, the program instructions can be encoded on an artificially-generated propagated signal, e.g., a machine-generated electrical, optical, or electromagnetic signal, that is generated to encode information for transmission to suitable receiver apparatus for execution by a data processing apparatus. A computer storage medium can be, or be included in, a computer-readable storage device, a computer-readable storage substrate, a random or serial access memory array or device, or a combination of one or more of them. Moreover, while a computer storage medium is not a propagated signal, a computer storage medium can be a source or destination of computer program instructions encoded in an artificially-generated propagated signal. The computer storage medium can also be, or be included in, one or more separate components or media (e.g., multiple CDs, disks, or other storage devices). Accordingly, the computer storage medium may be tangible and non-transitory.

The operations described in this specification can be implemented as operations performed by a data processing apparatus on data stored on one or more computer-readable storage devices or received from other sources.

The term "client or "server" includes a variety of apparatuses, devices, and machines for processing data, including by way of example a programmable processor, a computer, a system on a chip, or multiple ones, or combinations, of the foregoing. The apparatus can include special purpose logic circuitry, e.g., an FPGA (field programmable gate array) or an ASIC (application-specific integrated circuit). The apparatus can also include, in addition to hardware, a code that creates an execution environment for the computer program in question, e.g., a code that constitutes processor firmware, a protocol stack, a database management system, an operating system, a cross-platform runtime environment, a virtual machine, or a combination of one or more of them. The apparatus and execution environment can realize various different computing model infrastructures, such as web services, distributed computing and grid computing infrastructures.

A computer program (also known as a program, software, software application, script, or code) can be written in any form of programming language, including compiled or interpreted languages, declarative or procedural languages, and it can be deployed in any form, including as a standalone program or as a module, component, subroutine, object, or other unit suitable for use in a computing environment. A computer program may, but need not, correspond to a file in a file system. A program can be stored in a portion of a file that holds other programs or data (e.g., one or more scripts stored in a markup language document), in a single file dedicated to the program in question, or in multiple coordinated files (e.g., files that store one or more modules, sub-programs, or portions of code). A computer program can be deployed to be executed on one computer or on multiple computers that are located at one site or distributed across multiple sites and interconnected by a communication network.

The processes and logic flows described in this specification can be performed by one or more programmable processors executing one or more computer programs to perform actions by operating on input data and generating output. The processes and logic flows can also be performed by, and apparatus can also be implemented as, special purpose logic circuitry, e.g., an FPGA (field programmable gate array) or an ASIC (application specific integrated circuit).

Processors suitable for the execution of a computer program include, by way of example, both general and special purpose microprocessors, and any one or more processors of any kind of digital computer. Generally, a processor will receive instructions and data from a read-only memory or a random access memory or both. The essential elements of a computer are a processor for performing actions in accordance with instructions and one or more memory devices for storing instructions and data. Generally, a computer will also include, or be operatively coupled to receive data from or transfer data to, or both, one or more mass storage devices for storing data, e.g., magnetic, magneto-optical disks, or optical disks. However, a computer need not have such devices. Moreover, a computer can be embedded in another device, e.g., a mobile telephone, a personal digital assistant (PDA), a mobile audio or video player, a game console, or a portable storage device (e.g., a universal serial bus (USB) flash drive). Devices suitable for storing computer program instructions and data include all forms of non-volatile memory, media and memory devices, including by way of example semiconductor memory devices, e.g., EPROM, EEPROM, and flash memory devices; magnetic disks, e.g., internal hard disks or removable disks; magneto-optical disks; and CD-ROM and DVD-ROM disks. The processor and the memory can be supplemented by, or incorporated in, special purpose logic circuitry.

To provide for interaction with a user, implementations of the subject matter described in this specification can be implemented on a computer having a display device, e.g., a CRT (cathode ray tube), LCD (liquid crystal display), OLED (organic light emitting diode), TFT (thin-film transistor), plasma, other flexible configuration, or any other monitor for displaying information to the user and a keyboard, a pointing device, e.g., a mouse, trackball, etc., or a touch screen, touch pad, etc., by which the user can provide input to the computer. Other kinds of devices can be used to provide for interaction with a user as well. For example, feedback provided to the user can be any form of sensory feedback, e.g., visual feedback, auditory feedback, or tactile feedback and input from the user can be received in any form, including acoustic, speech, or tactile input. In addition, a computer can interact with a user by sending documents to and receiving documents from a device that is used by the user. For example, by sending webpages to a web browser on a user's client device in response to requests received from the web browser.

Implementations of the subject matter described in this specification can be implemented in a computing system that includes a back-end component, e.g., as a data server, or that includes a middleware component, e.g., an application server, or that includes a front-end component, e.g., a client computer having a graphical user interface or a Web browser through which a user can interact with an implementation of the subject matter described in this specification, or any combination of one or more such back-end, middleware, or front-end components. The components of the system can be interconnected by any form or medium of digital data communication, e.g., a communication network. Examples of communication networks include a local area network ("LAN") and a wide area network ("WAN"), an internetwork (e.g., the Internet), and peer-to-peer networks (e.g., ad hoc peer-to-peer networks).

While this specification contains many specific implementation details, these should not be construed as limitations on the scope of any inventions or of what may be claimed, but rather as descriptions of features specific to particular implementations of particular inventions. Certain features that are described in this specification in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown, in sequential order or that all illustrated operations be performed to achieve desirable results. In certain circumstances, multitasking and parallel processing may be advantageous. Moreover, the separation of various system components in the implementations described above should not be understood as requiring such separation in all implementations and it should be understood that the described program components and systems can generally be integrated together in a single software product or packaged into multiple software products.

Thus, particular implementations of the subject matter have been described. Other implementations are within the scope of the following claims. In some cases, the actions recited in the claims can be performed in a different order and still achieve desirable results. In addition, the processes depicted in the accompanying figures do not necessarily require the particular order shown, or sequential order, to achieve desirable results. In certain implementations, multitasking or parallel processing may be utilized.

The invention is claimed as follows:

1. A method of operating a gaming system, the method comprising:

(a) receiving, by an acceptor, a physical item associated with a monetary value;

(b) establishing, by at least one processor, a credit balance based at least in part on the monetary value associated with the received physical item;

(c) causing, by the at least one processor, displaying, by at least one display device to display a keno game board including a set of a plurality of different symbols;

(d) receiving, by an input device, a selection of a quantity of the plurality of different symbols of the set to form a player symbol set;

(e) receiving an actuation of a wager button;

(f) placing, by the at least one processor, a wager responsive to the actuation of the wager button, the credit balance decreasable by the wager;

(g) forming, by the at least one processor, a gaming system symbol set by randomly selecting two or more of the plurality of different symbols of the set;

(h) repeating (g) at least once to form at least one additional gaming system symbol set;

(i) causing, by the at least one processor, the at least one display device to display the randomly-determined symbols in the gaming system symbol sets;

(j) determining, by the at least one processor, an award based at least in part on: (1) any symbols in the player symbol set that match a symbol in one of the gaming system symbol sets; and (2) a scatter pay evaluation of the displayed randomly-determined symbols in the gaming system symbol sets;

(k) receiving an actuation of a cashout button; and (l) initiating, by the at least one processor, a payout associated with the credit balance responsive to the actuation of the cashout button.

2. The method of claim 1, which includes dividing, by the at least one processor, the displayed randomly-determined symbols in the gaming system symbol sets into a plurality of different groups.

3. The method of claim 2, wherein determining the award based at least in part on the scatter pay evaluation includes determining, by the at least one processor and for each group, a quantity of matching symbols in that group.

4. The method of claim 2, wherein causing, by the at least one processor, the at least one display device to display the randomly-determined symbols in the gaming system symbol sets includes: (1) for each gaming system symbol set, causing, by the at least one processor, the at least one display device to display the randomly-determined symbols in that gaming system symbol set in one of a column and a row; and (2) causing, by the at least one processor, the at least one display device to display the symbols of the plurality of gaming system symbol sets adjacent one another.

5. The method of claim 2, wherein each group includes at least one symbol from two or more of the gaming system symbol sets.

6. The method of claim 1, wherein each gaming system symbol set includes the same number of symbols.

7. The method of claim 1, which includes: (1) receiving, by a player tracking card reader of a player tracking device, a player tracking card; and (2) reading, by the player tracking card reader, the received player tracking card to facilitate tracking game play.

8. The method of claim 7, which includes printing, by a ticket printer, a ticket associated with a value representative of the credit balance responsive to the actuation of the cashout button.

9. The method of claim 8, which includes monitoring, by a sensor, whether a gaming system door is open or closed.

10. The method of claim 1, which is at least partially provided through a data network.

11. The method of claim 10, wherein the data network is an internet.

12. A gaming system comprising:

a housing;

at least one display device supported by the housing;

a plurality of input devices supported by the housing and including an acceptor;

at least one processor; and at least one memory device that stores a plurality of instructions that, when executed by the at least one processor, cause the at least one processor to:

(a) establish a credit balance based at least in part on a monetary value associated a physical item after the acceptor receives the physical item;

(b) cause the at least one display device to display a keno game board including a set of a plurality of different symbols;

(c) form a player symbol set following receipt of a selection of a quantity of the plurality of different symbols of the set;

(d) place a wager following receipt of an actuation of a wager button, the credit balance decreasable by the wager;

(e) form a gaming system symbol set by randomly selecting two or more of the plurality of different symbols of the set;

(f) repeat (e) at least once to form at least one additional gaming system symbol set;

(g) cause the at least one display device to display the randomly-determined symbols in the gaming system symbol sets;

(h) determine an award based at least in part on: (1) any symbols in the player symbol set that match a symbol in one of the gaming system symbol sets; and (2) a scatter pay evaluation of the displayed randomly-determined symbols in the gaming system symbol sets; and (i) initiate a payout associated with the first credit balance following receipt of an actuation of a cashout button.

13. The gaming system of claim 12, wherein the plurality of instructions, when executed by the at least one processor, cause the at least one processor to divide the displayed randomly-determined symbols in the gaming system symbol sets into a plurality of different groups.

14. The gaming system of claim 13, wherein the plurality of instructions, when executed by the at least one processor, cause the at least one processor to determine the award based at least in part on the scatter pay evaluation by determining, for each group, a quantity of matching symbols in that group.

15. The gaming system of claim 13, wherein the plurality of instructions, when executed by the at least one processor, cause the at least one processor to cause the at least one display device to display the randomly-determined symbols in the gaming system symbol sets by: (1) for each gaming system symbol set, causing the at least one display device to display the randomly-determined symbols in that gaming system symbol set in one of a column and a row; and (2) causing the at least one display device to display the symbols of the plurality of gaming system symbol sets adjacent one another.

16. The gaming system of claim 13, wherein each group includes at least one symbol from two or more of the gaming system symbol sets.

17. The gaming system of claim 12, wherein each gaming system symbol set includes the same number of symbols.

18. The gaming system of claim 12, which includes a player tracking device including a player card reader configured to receive and read a player tracking card to facilitate tracking game play.

19. The gaming system of claim 18, which includes a ticket printer configured to print a ticket associated with a value representative of the credit balance responsive to the actuation of the cashout button.

20. The gaming system of claim 19, which includes a door and a sensor supported by the housing, the sensor configured to monitor whether the door is open or closed.

* * * * *